US008859870B2

(12) United States Patent
Yamane

(10) Patent No.: US 8,859,870 B2
(45) Date of Patent: Oct. 14, 2014

(54) PEDAL PERCUSSION INSTRUMENT

(71) Applicant: Roland Corporation, Shizuoka (JP)

(72) Inventor: Hideaki Yamane, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 13/948,162

(22) Filed: Jul. 22, 2013

(65) Prior Publication Data

US 2014/0102282 A1 Apr. 17, 2014

(30) Foreign Application Priority Data

Oct. 17, 2012 (JP) ..... 2012-229491

(51) Int. Cl.
*G10D 13/02* (2006.01)
*G10D 13/00* (2006.01)

(52) U.S. Cl.
CPC ..... *G10D 13/006* (2013.01)
USPC ..... 84/422.1

(58) Field of Classification Search
CPC ..... G10D 13/006
See application file for complete search history.

(56) References Cited

U.S. PATENT DOCUMENTS 1,209,804 A * 12/1916 Bessinger ..... 84/422.2
2,484,302 A * 10/1949 Laverents ..... 84/422.1
2,548,271 A * 4/1951 Percy ..... 84/411 R
2,581,515 A * 1/1952 Christian ..... 84/422.1
2,658,421 A * 11/1953 Clayton ..... 84/422.1
3,618,441 A * 11/1971 Fearns ..... 84/422.1
4,200,025 A * 4/1980 Currier ..... 84/422.1
4,747,333 A * 5/1988 Hoshino ..... 84/422.1
4,782,733 A * 11/1988 Herring ..... 84/422.1
4,817,485 A 4/1989 Bozzio et al.
5,090,289 A * 2/1992 Holcomb ..... 84/422.1
5,301,592 A 4/1994 Johnston
5,458,039 A * 10/1995 Ashby ..... 84/422.1
5,866,830 A * 2/1999 Onyszkanycz ..... 84/422.1
6,541,686 B2 * 4/2003 O'Donnell ..... 84/422.1
6,649,820 B2 * 11/2003 Sassmannshausen ..... 84/422.1
7,074,997 B2 * 7/2006 Steele ..... 84/422.1
7,531,733 B2 * 5/2009 Steele ..... 84/422.1
7,928,302 B2 4/2011 Sandson
8,373,052 B2 * 2/2013 Yoshino ..... 84/411 M
2006/0000341 A1 * 1/2006 Steele ..... 84/422.1

(Continued)

FOREIGN PATENT DOCUMENTS

JP S63-054198 4/1988
JP H06-008998 2/1994

(Continued)

*Primary Examiner* — Robert W Horn
(74) *Attorney, Agent, or Firm* — Jianq Chyun IP Office

(57) ABSTRACT

A pedal percussion instrument includes a base, a pedal, a connecting member, a rotating body, a shaft pivotally connecting the rotating body, a striking part rotating about the shaft and a stricken part. The shaft is located between an upper end and a lower end of the pedal part when the pedal part is not being operated. The striking part is disposed on a side opposite to the pedal part with the shaft interposed therebetween and is disposed on a side lower than the stricken part when the pedal part is not being operated. The pedal part rotates in one direction with respect to the base, the rotating body rotates via the connecting member in an other direction with respect to the base. The stricken part is struck by the striking part through a rotation of the rotating body in the other direction in a predetermined angle.

16 Claims, 6 Drawing Sheets

(56) References Cited

U.S. PATENT DOCUMENTS

| | | | | |
|---|---|---|---|---|
| 2006/0150801 | A1* | 7/2006 | Veiga | 84/422.1 |
| 2007/0234876 | A1* | 10/2007 | Veiga | 84/422.1 |
| 2012/0097011 | A1* | 4/2012 | Leopold | 84/422.4 |
| 2012/0152085 | A1* | 6/2012 | Gordon, Sr. | 84/422.1 |
| 2012/0198984 | A1* | 8/2012 | Johnston | 84/422.1 |
| 2014/0102282 | A1* | 4/2014 | Yamane | 84/422.1 |

FOREIGN PATENT DOCUMENTS

| | | |
|---|---|---|
| JP | 2012-037661 | 2/2012 |
| JP | 2012-073462 | 4/2012 |
| JP | 2012-189816 | 10/2012 |

* cited by examiner

PEDAL PERCUSSION INSTRUMENT

CROSS-REFERENCE TO RELATED APPLICATIONS

This application claims the priority benefit of Japan application serial no. 2012-229491, filed on Oct. 17, 2012. The entirety of the above-mentioned patent application is hereby incorporated by reference herein and made a part of this specification.

BACKGROUND OF THE INVENTION

1. Field of the invention

The present invention relates to a pedal percussion instrument, and more particularly, to a pedal percussion instrument which can be miniaturized, and the sense of operating the pedal apparatus, being similar to that of using a pedal apparatus to play an acoustic bass drum, can be obtained by stepping on the pedal apparatus.

2. Description of the Related Art

A pedal percussion instrument, which simulates an acoustic bass drum for playing by using a pedal apparatus having a strike part that rotates following a stepping action on a pedal part caused by a player, is known.

For example, U.S. Pat. No. 4,200,025 discloses a pedal percussion instrument, wherein a stricken part 120 and a striking part 150 that strikes the stricken part 120 and rotates following a stepping on a foot pedal 114 by a player, are arranged below the foot pedal 114.

In addition, Japan Utility Model Publication No. H06-008998 Gazette discloses a pedal percussion instrument in which a stricken surface part 3*a* (stricken part) is struck by a beater 17 (rotating body, striking part), wherein the beater 17 is pulled down following a stepping on a pedal 19 (pedal part) by a player.

However, the above-mentioned pedal percussion instrument disclosed in Patent document 1 requires a space for rotating the striking part 150 below the foot pedal 114. Therefore, there is a problem of the entire percussion instrument being overly bulky.

In addition, in the above-mentioned pedal percussion instrument disclosed in Patent document 2, the stricken surface part 3*a* is struck by swinging the beater 17 downward in a manner following the stepping action on the pedal 19. Therefore, there is a problem that the sense of stepping the pedal part is different from that of an acoustic bass drum, which is struck by swinging the striking part upward in a manner follow by the stepping on the pedal part in the pedal apparatus.

The present invention has been made in order to solve the above-mentioned problems. An object of the present invention is to provide a pedal percussion instrument which can be miniaturized and the sense of operating the pedal apparatus can be similar to that of playing an acoustic bass drum by stepping a pedal apparatus.

PRIOR ART REFERENCE

Patent Document

Patent document 1: U.S. Pat. No. 4,200,025 (Please refer to FIG. 4)

Patent document 2: Japan Utility Model Publication No. H06-008998 Gazette (Please refer to paragraph [0013] and FIG. 3 etc.)

SUMMARY OF THE INVENTION

According to one aspect of the present invention, the pedal percussion instrument has the following effect. A horizontal direction is a direction parallel to the extension direction of the base plate of the pedal percussion instrument. A vertical direction is a direction perpendicular to the base plate. A striking part is positioned opposite to a pedal part with a first axis interposed therebetween in the horizontal direction. In addition, the striking part is positioned lower than a stricken part (part being struck) in the vertical direction when the pedal part is not being operated. Moreover, the pedal part rotates in one direction with respect to a base when a stepping operation is performed by a player. Hereby, a rotating body rotates in the other direction with respect to the base via a connecting member. Then, the striking part disposed on one end side of the rotating body is lifted upward in the vertical direction. In addition, when the rotating body rotates at a predetermined angle in the other direction, the stricken part positioned higher than the striking part in the vertical direction is struck by the striking part.

Thus, when operating the pedal part and striking the stricken part by the striking part, a player can feel a weight feeling by lifting upward the striking part in the vertical direction.

When a player uses the pedal apparatus to play the acoustic bass drum, the striking part is lifted upward in the vertical direction following the stepping operation on the pedal part. Therefore, the player feels a weight feeling when stepping on the pedal part of the pedal apparatus.

According to the pedal percussion instrument of the present invention, a player can feel a weight feeling when performing the stepping operation of the pedal part. Accordingly, a sense similar to that of playing the acoustic bass drum can be obtained by stepping on the pedal part of the pedal apparatus.

In addition, the first shaft is located between an upper end and a lower end of the pedal part in the vertical direction when the pedal part is not being operated. Therefore, comparing with a case in which the first shaft is positioned higher than the upper end of the pedal part in the vertical direction when the pedal part is not being operated, the size of the pedal percussion instrument can be reduced.

According to other aspect of the present invention, the pedal percussion instrument has the following additional effect. The striking part is configured in manner that the elastic member including an elastic material faces the stricken part. Therefore, when striking the stricken part by the striking part, the elastic member contacts the stricken part. Accordingly, a percussion sound produced when striking the stricken part by the striking part can be reduced.

In addition, in the striking part, a weight part serving as a weight is attached on a side of the elastic member, and another side of the elastic member, which is opposite to the side of the elastic member attached with the weight part, faces the stricken part. Therefore, even if a distance between the striking part and the first shaft is shortened, a player senses a sufficient weight when operating the pedal part. Accordingly, the sense of operating the pedal apparatus similar to that of using the pedal apparatus to play the acoustic bass drum can be obtained by stepping the pedal part in the pedal apparatus, while reducing the size of the pedal percussion instrument.

According to a further aspect of the present invention, the pedal percussion instrument has the following additional effect. When the pedal part is rotated in one direction by the stepping operation on the pedal part by a player and the rotating body is rotated in the other direction, a biasing force which rotates the rotating body in one direction and rotates the pedal part in the other direction is applied by a biasing member. Accordingly, when the pedal part is released from being stepped, the pedal part and the rotating body are returned to a position before the stepping operation.

In addition, when the pedal part is not being operated, the striking part is held apart from a floor surface and the base by the biasing member. Accordingly, the striking part, which rotates in one direction after the stepping of the pedal is released, can be easily prevented from crashing onto the floor surface or the base.

According to a further aspect of the present invention, the pedal percussion instrument has the following additional effect. In the stricken part, a striking surface is positioned higher than an axis center of the first shaft in the vertical direction so that a distance between the striking part and the stricken part can be ensured. An amplitude of the striking part, which is a distance that the striking part travels to abut against the stricken part from the moment the pedal not being stepped on till the moment the pedal being stepped on, can be ensured. Therefore, the rotation angle of the pedal part when the striking part strikes the stricken part can be ensured. Accordingly, the rotation angle of the pedal part can be approximated as a rotation angle of the pedal when the acoustic bass drum is struck by the pedal apparatus. As a result, the sense of operating the pedal apparatus similar to that of using the pedal apparatus to play the acoustic bass drum can be obtained by stepping the pedal part of the pedal apparatus.

According to a further aspect of the present invention, the pedal percussion instrument has the following additional effect. In the stricken part, the striking surface is located closer to the pedal part than the axis center of the first shaft in the horizontal direction. Therefore, comparing with a case in which the striking surface is located further away from the pedal part than the axis center of the first shaft in the horizontal direction, a distance between the striking part and the floor surface or the base can be significantly ensured when the pedal part is not being operated. Accordingly, when the pedal part is released after being stepped, the rotating body is rotated in the one direction while the striking part can be easily prevented from crashing onto the floor surface or the base.

According to a further aspect of the present invention, the pedal percussion instrument has the following additional effect. One of the striking part and the stricken part comprises the elastic member including an elastic material. The elastic member is disposed at a surface of either the striking part or the stricken part, and facing the other one of the striking part and the stricken part. Therefore, when the stricken part is struck by the striking part, the elastic member contacts the other one of the striking part and the stricken part. Accordingly, a percussion sound produced when the stricken part is struck by the striking part can be reduced.

In addition, the elastic member includes an elastic material. The elastic member is disposed at a surface of one of the striking part and the stricken part and has a cross-section parallel to the surface of the one of the striking part and the stricken part. An area of the cross-section becomes increases as a distance between the cross-section of the elastic member and the surface of the one of the striking part and the stricken part decreases. Accordingly, the stronger the striking part presses against the stricken part, the greater the force rebounding the striking part toward one direction and the greater the force pushing the pedal part toward the other direction by an elastic restoring force of the elastic member.

In a case when a player uses the striking part of the pedal apparatus to strike a head which is configured as the stricken surface of the acoustic bass drum, the stronger the striking part presses the head, the greater the rebounding force is to rebound the striking part and the greater the pushing force is to push the pedal part toward the other direction due to a tension of the head.

Accordingly, when the pedal part is being operated by a player and the stricken part is struck by the striking part, a sense similar to that of the striking of the acoustic bass drum by the pedal apparatus can be obtained.

According to a further aspect of the present invention, the pedal percussion instrument has the following additional effect. A fourth shaft which pivotally connects the one end side of the rotating body and the other end side of the connecting member is positioned opposite to a second shaft with a third shaft interposed therebetween in the horizontal direction. The fourth shaft is positioned opposite to the striking part with the first shaft interposed therebetween in the horizontal direction, and is between the second shaft and the third shaft in the vertical direction. Therefore, the pedal part that is stepped and operated by a player is rotated in one direction, the one end side of the rotating body is pushed downward and rotated in the other direction via the connecting member, and the striking part disposed on the other end side of the rotating body can be lifted upward in the vertical direction.

Accordingly, when a player operating the pedal part and striking the stricken part by the striking part, the player can feel a weight feeling by lifting upward the striking part in the vertical direction. As a result, a sense of operating the pedal apparatus similar to that of using the pedal apparatus to play the acoustic bass drum can be obtained by stepping on the pedal part in the pedal apparatus.

In addition, the first shaft is located between the second shaft and the third shaft in the vertical direction when the pedal part is not being operated. Accordingly, comparing with a case in which the first shaft is positioned higher than the third shaft in the vertical direction when the pedal part is not being operated, the size of the pedal percussion instrument can be reduced.

According to a further aspect of the present invention, the pedal percussion instrument has the following additional effect. A distance between the axis center of the first shaft and a center of gravity of the striking part is shorter than a distance between the axis center of the first shaft and an axis center of the fourth shaft. Accordingly, a length from the first shaft to the striking part can be shortened. Moreover, the stricken part located on a rotational orbit of the striking part can be disposed on a position closer to a rotating shaft. As a result, the size of the pedal percussion instrument can be reduced.

According to a further aspect of the present invention, the pedal percussion instrument has the following additional effect. A distance between the axis center of the first shaft and a striking point is shorter than a distance between the axis center of the first shaft and the axis center of the fourth shaft. Accordingly, a length from the first shaft to the striking part can be shortened. Moreover, the stricken part located on the rotational orbit of the striking part can be disposed on a position closer to the first shaft. As a result, the size of the pedal percussion instrument can be reduced.

According to a further aspect of the present invention, the pedal percussion instrument has the following additional effect. The pedal percussion instrument includes a sensor for detecting the event that the stricken part is struck. Accordingly, the pedal percussion instrument can be used as an electronic percussion instrument.

DESCRIPTION OF EMBODIMENTS

Figure 1A:
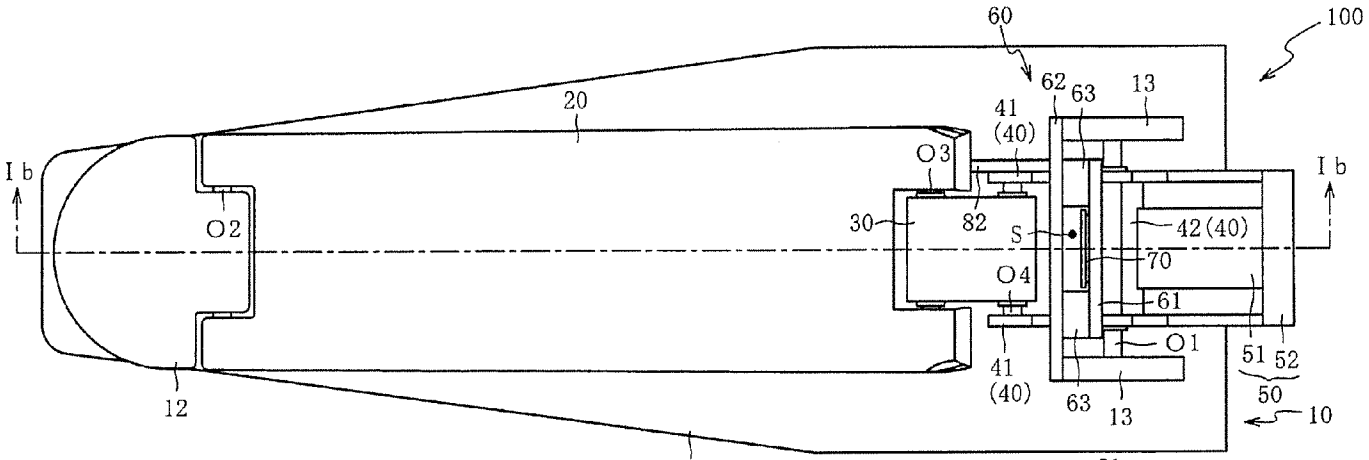
FIG. 1A is a top view of a pedal percussion instrument according to a first embodiment of the present invention.
Figure 1B:
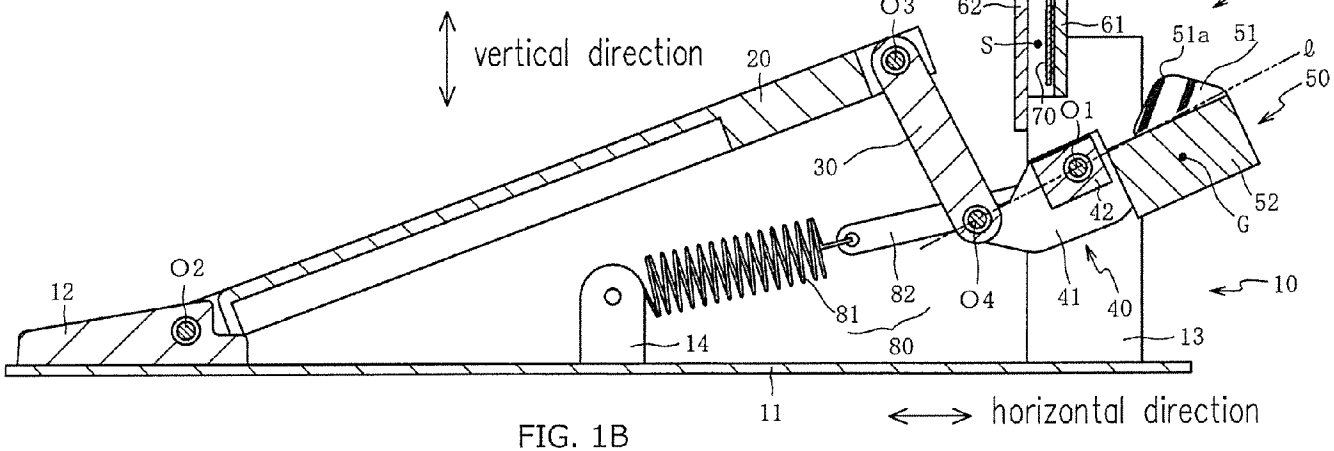
FIG. 1B is a cross-sectional view of the pedal percussion instrument on the line Ib-Ib in FIG. 1A.
Figure 2:
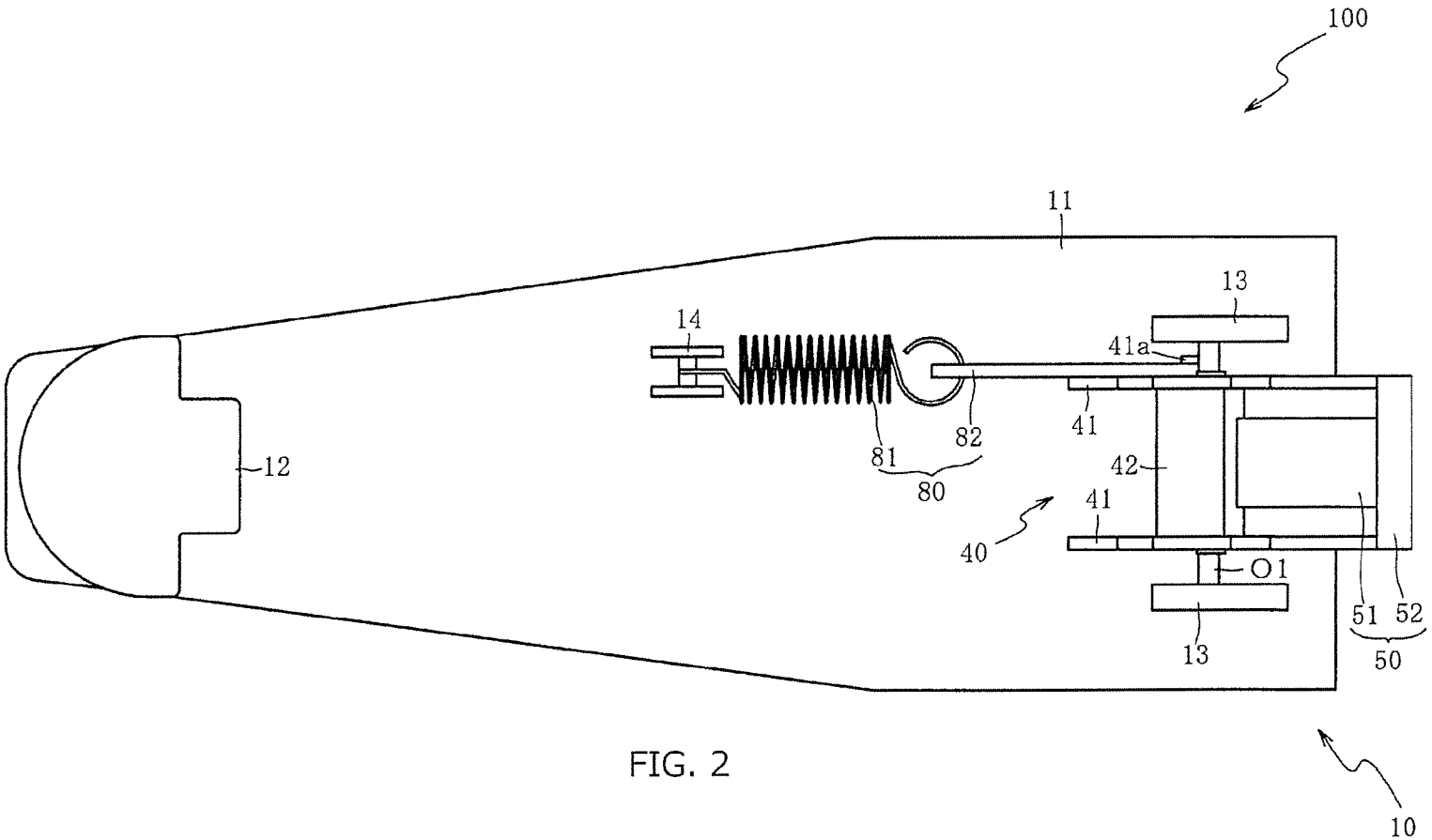
FIG. 2 is a top view of the pedal percussion instrument.
Figure 3:
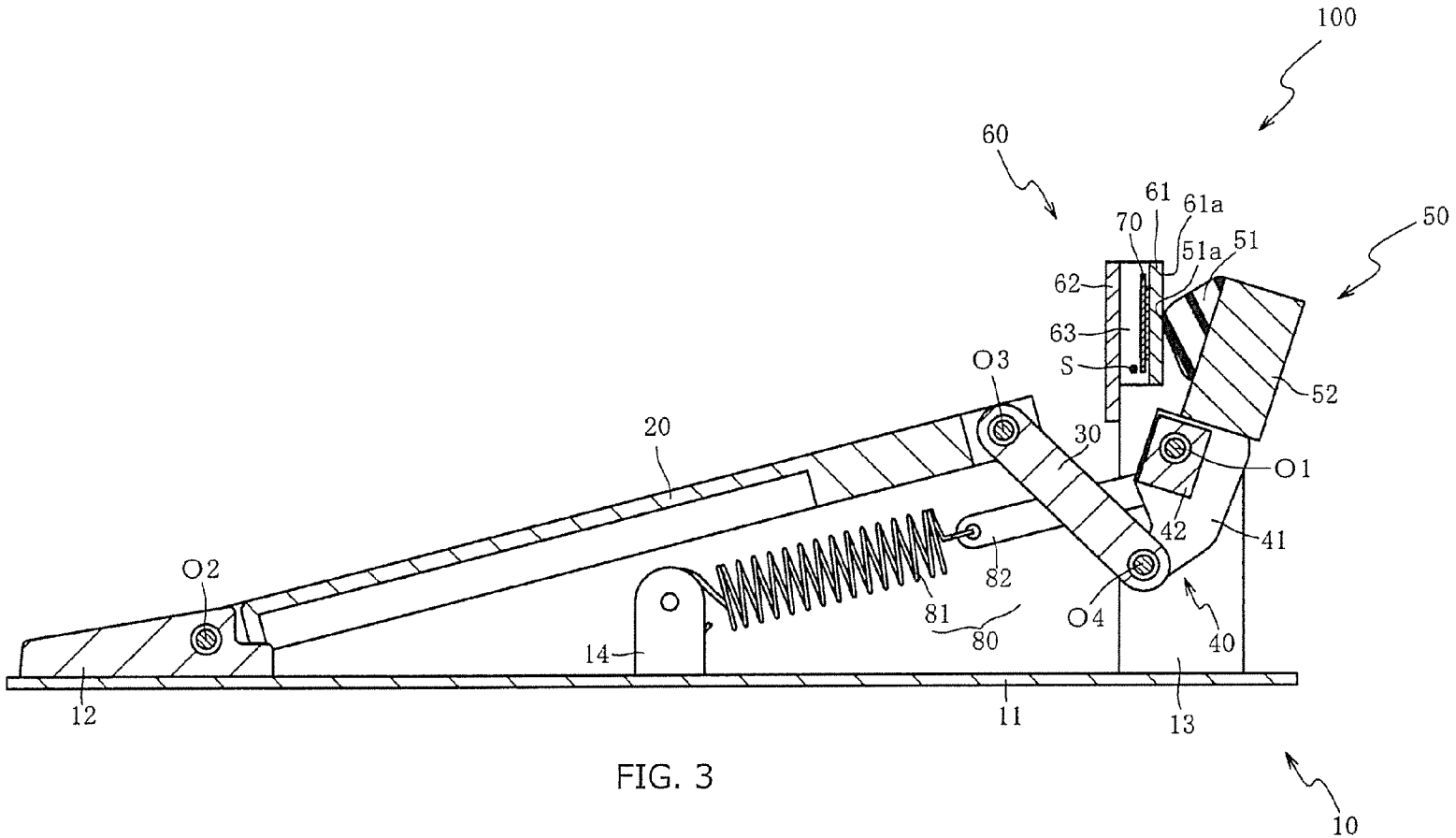
FIG. 3 is a cross-sectional view of the pedal percussion instrument.

Preferred embodiments of the present invention are described below referring to the accompanying drawings. First, referring to FIG. 1-FIG. 3, a pedal percussion instrument 100 according to a first embodiment is described. FIG. 1A is a top view of the pedal percussion instrument 100 according to the first embodiment of the present invention. FIG. 1B is a cross-sectional view of the pedal percussion instrument 100 along the line Ib-Ib in FIG. 1A. FIG. 2 is a top view of the pedal percussion instrument 100. FIG. 2 also illustrates a state in which a pedal part 20, a connecting member 30 and a stricken part 60 are removed. FIG. 3 is a cross-sectional view of the pedal percussion instrument 100. FIG. 3 also illustrates a state in which a stepping operation is performed on the pedal 20 and the stricken part 60 is struck by the striking part 50. In FIG. 3, a cross-section corresponding to FIG. 1B is shown.

As shown in FIG. 1 and FIG. 2, the pedal percussion instrument 100 is a pedal apparatus that has a striking part rotating following the stepping operation on the pedal part. Moreover, the pedal percussion instrument 100 is an electronic percussion instrument which simulates an acoustic bass drum played by using the pedal apparatus. The pedal percussion instrument 100 mainly includes a base 10, the pedal part 20, the connecting member 30, a rotating body 40, the striking part 50, the stricken part 60 and a vibration sensor 70. The base 10 is placed on a floor surface. The pedal part 20 is pivotally connected to the base 10 in a manner that the pedal part 20 is rotatable. The connecting member 30 is pivotally connected to the pedal part 20 in a manner that one end side of the connecting member 30 is rotatable. The rotating body 40 is pivotally connected to the other end side of the connecting member 30 in a manner that the rotating body 40 is rotatable. The striking part 50 is disposed on one end side of the rotating body 40. The stricken part 60 is located on a rotational orbit of the striking part 50. The vibration sensor 70 is attached to the stricken part 60.

The base 10 is a part which is used for the foundation of the pedal percussion instrument 100. In addition, the base 10 includes a base plate 11, a pedal pivot part 12, a pair of erected parts 13 and a spring connecting part 14. The base plate 11 contacts the floor surface and is formed in a long plate shape. The pedal pivot part 12 is disposed on one side of the base plate 11 in a longitudinal direction of the base plate 11. The pair of erected parts 13 is set up on the other side of the base plate 11 in a manner that one erected part 13 faces the other erected part 13. The spring connecting part 14 is formed on the base plate 11 between the pedal pivot part 12 and the pair of erected parts 13.

The pedal part 20 is a part which rotates by the stepping operation by a player and is formed in a long plate shape. One end side of the pedal part 20 in a longitudinal direction of the pedal part 20 is rotatably held on the pedal pivot part 12 of the base 10 by rendering the longitudinal direction of the pedal part 20 identical to the longitudinal direction of the base plate 11.

The connecting member 30 is a rod-shaped link which has a predetermined stiffness. The one end side of the connecting member 30 is rotatably held on the other end side of the pedal part 20 in the longitudinal direction of the pedal part 20.

The rotating body 40 is a part which rotates following the stepping operation of the pedal part 20 performed by a player. The rotating body 40 is positioned opposite to the pedal part 20 with the connecting member 30 interposed therebetween in a horizontal direction. In addition, the rotating body 40 includes a pair of rotating plates 41 facing each other and a rotating shaft part 42 connecting the pair of rotating plates 41.

Each of the pair of rotating plates 41 is formed in a long plate shape and is rotatably held at the other end side of the connecting member 30. In addition, a projection 41*a* (see FIG. 2) is formed on one of the pair of rotating plates 41 (upper rotating plate 41 in FIG. 2). The projection 41*a* is protruded toward a side away from the other rotating plate 41.

The pair of the rotating plates 41 and the rotating shaft part 42 is pivotally connected through a first shaft O1. The first shaft O1 is disposed between the pair of erected parts 13 of the base 10, and the rotating body 40 is rotatably held on the pair of the erected parts 13.

In the embodiment, the rotating body 40 is pivotally connected to the first shaft O1 in a manner that the rotating body 40 is rotatable by disposing the first shaft O1 between the pair of erected parts 13. Alternatively, the first shaft O1 may be fastened or formed integrally with the rotating body 40, and the first shaft O1 may be rotatably held to the pair of the erected parts 13.

A biasing member 80 connecting the base 10 and the rotating body 40 is disposed below the pedal part 20. The biasing member 80 applies a biasing force on the pedal part 20 and the rotating body 40. The biasing member 80 includes an extension coil spring. Moreover, the biasing member 80 includes a spring member 81 and a biasing force transmission part 82. The spring member 81 has one end connected to the spring connecting part 14 of the base 10. The biasing force transmission part 82 has one end side connected to the other end of the spring member 81 and has the other end side connected to the projection 41*a* of the rotating body 40.

The biasing member 80 connects the spring connecting part 14 and the projection 41*a* while the biasing force is applied to the spring member 81. Hereby, when the pedal part 20 is not being operated (hereinafter "initial condition"), the spring connecting part 14 and the projection 41 are at such positions that a distance therebetween becomes the shortest, and the rotating body 40 can be rested at a predetermined position. In addition, by resting the rotating body 40 at the predetermined position, the connecting member 30 pivotally connected to the rotating body 40 and the pedal part 20 pivotally connected to the connecting member 30 can be rested at a predetermined position. In addition, in the initial condition, the biasing member 80 is held approximately in parallel to the pedal part 20. Hereby, a space between the pedal part 20 and the base 10 can be effectively utilized, and the size of the pedal percussion instrument 100 can be reduced.

A second shaft O2 pivotally supports the one end side of the pedal part 20 against the pedal pivot part 12 of the base 10. In addition, a third shaft O3 pivotally supports the one end side of the connecting member 30 against the other end side of the pedal part 20. In the initial condition, the third shaft O3 is positioned higher than the second shaft O2 in the vertical direction. Hereby, the pedal part 20 can be rested in a state in which the other end side of the pedal part 20 in the longitudinal direction of the pedal part 20 is positioned higher than the one end side of the pedal part 20 in the longitudinal direction of the pedal part 20 in the vertical direction. Accordingly, a distance that the pedal travels can be ensured when performing the stepping operation of the pedal part 2.

Moreover, in the initial condition, the first shaft O1 is located between the third shaft O3 and the second shaft O2 in the vertical direction, which is between an upper end and a lower end of the pedal part 20 in the vertical direction. Accordingly, comparing with a case in which the first shaft O1 is positioned higher than the third shaft O3 or the upper end of the pedal part 20 in the vertical direction in the initial condition, the size of the pedal percussion instrument 100 can be reduced.

In addition, the fourth shaft O4 pivotally supports the rotating plate 41 of the rotating body 40 against the other end side of the connecting member 30. The fourth shaft O4 is positioned opposite to the second shaft O2 with the third shaft O3 interposed therebetween in the horizontal direction, and is positioned closer to the pedal part 20 than the first shaft O1 in the horizontal direction, and is between the second shaft O2 and the third shaft O3 in the vertical direction. In addition, the striking part 50 disposed on the one end side of the rotating body 40 is disposed on a side opposite to the fourth shaft O4 with the first shaft O1 interposed therebetween, that is the side opposite to the pedal part 20 with the first shaft O1 interposed therebetween in the horizontal direction. In other words, the first shaft O1 is located between the striking part 50 and the fourth shaft O4. Moreover, the striking part 50 rests at a predetermined height away from the floor surface and the base plate 11 of the base 10 in the initial condition.

The striking part 50 is a part for striking the stricken part 60. The striking part 50 is fastened to the pair of the rotating body 41 in a manner that the striking part 50 is opposite to the fourth shaft O4 with the rotating shaft part 42 of the rotating body 40 interposed therebetween. The striking part 50 includes an elastic member 51 and a weight part 52. The elastic member 51 is disposed on a position facing the stricken part 60. The weight part 52 is attached to a side of the elastic member 51 opposite to another side of the elastic member 51 facing the stricken part 60.

The elastic member 51 is a member that contacts the stricken part 60 when the striking part 50 strikes the stricken part 60. The elastic member 51 includes a rubber material. Furthermore, the elastic member 51 may include an elastic material except a rubber material, such as urethane.

The elastic member 51 is formed to have an approximately triangular cross-section perpendicular to the first shaft O1. The elastic member 51 is disposed at a surface of the striking part 50 and has another cross-section parallel to the surface of the striking part 50. The area of the another cross-section of the elastic member 51 increases as the distance between the another cross-section of the elastic member 51 and the surface of the striking part 50 decreases. In addition, the elastic member 51 is a part closest to the stricken part 60. A striking point 51*a* is a position of the striking part 50 at which the stricken part 60 first comes in contact with the striking part 50 when the striking part 50 strikes the stricken part 60. A distance between the striking point 51*a* and an axis center of the first shaft O1 is shorter than a distance between an axis center of the fourth shaft O4 and the axis center of the first shaft O1. Hereby, the striking part 50 can be rotated at a position near the first shaft O1 so that the size of the pedal percussion instrument 100 can be reduced.

The weight part 52 serves as a weight when the rotating body 40 rotates. The weight part 52 includes a metal material. Furthermore, the weight part 52 may include a resin material.

A distance between a center of gravity G of the striking part 50 and the axis center of the first shaft O1 is shorter than a distance between the axis center of the fourth shaft O4 and the axis center of the first shaft O1. Hereby, the striking part 50 can be rotated at a position near the first shaft O1 so that the size of the pedal percussion instrument 100 can be reduced.

In this case, the striking part 50 is preferably disposed at a position where a moment of mass M is approximately equal to a moment of mass M'. The moment of mass M is a multiplication of a distance from the center of gravity G to the first shaft O1 and a mass W of the striking part 50. In addition, the moment of mass M' is a multiplication of a distance from a center of gravity G' of the striking part (beater head) of the pedal apparatus (not shown) used for playing the acoustic bass drum to a rotating shaft O1' of the striking part and a mass W' of the striking part. Hereby, when stepping on the pedal part 20 of the pedal percussion instrument 100, the sense of operation similar to that of playing the acoustic bass drum by stepping the pedal apparatus can be obtained.

The stricken part 60 is a part which is struck by the striking part 50. The stricken part 60 is disposed on the rotational orbit of the striking part 50, and is higher than the axis center of the first shaft O1.

As described above, the distance from the center of gravity G to the first shaft O1 is shorter than the distance between the axis center of the fourth shaft O4 and the axis center of the first shaft O1. Moreover, the distance between the striking point 51*a* and the axis center of the first shaft O1 is shorter than the distance between the axis center of the fourth shaft O4 and the axis center of the first shaft O1. Therefore, the stricken part 60 located on the rotational orbit of the striking part 50 can be disposed at a position closer to the first shaft O1. Hereby, the size of the pedal percussion instrument 100 can be reduced.

The stricken part 60 includes a stricken plate 61, a fixing plate 62 and a pair of interposed members 63. The stricken plate 61 is located facing the striking part 50. The fixing plate 62 faces the stricken plate 61 and is positioned at a side of the stricken plate 61 away from the striking part 50. The pair of interposed members 63 is installed between the stricken plate 61 and fixing plate 62.

The stricken plate 61 is a part struck by the striking part 50. A stricken surface 61*a*, which faces the striking part 50, is positioned closer to the pedal part 20 than the axis center of the first shaft O1 in the horizontal direction (left side in FIG. 1B). Although, in the embodiment, the stricken surface 61*a* is vertical to the horizontal direction; however, the stricken surface 61 a may be positioned at an oblique angle to the horizontal direction.

In addition, by properly setting up a resting position of the rotating body 40 in the initial condition and adjusting a distance between the striking point 51*a* of the striking part 50 and the stricken surface 61*a* of the stricken part 60, a required rotation angle of the pedal part 20 when the striking part 50 strikes the stricken part 60, can be adjusted. As a result, the rotation angle of the pedal part 20 can be approximated as a rotation angle of the pedal part when the acoustic bass drum is struck by the pedal apparatus. Hereby, the sense of operating the pedal apparatus similar to that of using the pedal apparatus to play the acoustic bass drum by stepping the pedal apparatus can be obtained.

The fixing plate 62 is a part for fixing the stricken part 60 on the base 10. The fixing plate 62 is fixed on the pair of erected parts 13 at a position higher than the first shaft O1.

The pair of interposed members 63 includes an elastic material with a thickness (size in the crosswise direction in FIG. 1A) larger than the vibration sensor 70. The pair of interposed members 63 is fastened to the stricken plate 61 and the fixing plate 62 in a manner in which they are apart from each other in an axial direction of the first shaft O1. Hereby, a space S surrounded by the stricken plate 61, the fixing plate 62 and the pair of interposed members 63 is formed between the stricken plate 61 and the fixing plate 62.

The vibration sensor 70 is disposed inside the space S. The vibration sensor 70 is adhered to the stricken plate 61 on a surface opposite to the stricken surface 61*a*. Moreover, a gap is formed between the vibration sensor 70 and the fixing plate 62.

The vibration sensor 70 is a piezoelectric sensor for detecting a vibration of the stricken plate 61. The vibration sensor 70 is electrically connected to a musical device (not shown). When a vibration is generated on the stricken plate 61 after the stricken part 60 is struck by the striking part 50, the vibration on the stricken plate 61 is detected by the vibration sensor 70. Moreover, the detected signal detected by the vibration sensor 70 is output to a sound source apparatus. As a result, musical sound corresponding to a player's preference can be generated from the sound source apparatus according to the detected signal. In this way, since the pedal percussion instrument 100 includes the vibration sensor 70, the pedal percussion instrument 100 can be used as an electronic percussion instrument.

In addition, the vibration sensor 70 is disposed inside the space S with a gap formed between the fixing plate 62 and the vibration sensor 70. Accordingly, a vibration of the vibration sensor 70 can be prevented from being blocked by the fixing plate 62.

Moreover, the interposed members 63 include an elastic material. Therefore, a vibration of the stricken plate 61 resulted from being struck by the striking part 50 can be damped at an early stage. Moreover, a small unwanted vibration of the stricken plate 61 generated by the floor surface or the pedal part 20 can be suppressed. As a result, a false detection of the vibration sensor 70 can be suppressed.

As shown in FIG. 3, when the pedal part 20 is rotated in one direction (clockwise direction in FIG. 3) by the stepping operation of a player, the third shaft O3 pivotally connected to the other end side of the pedal part 20 in the longitudinal direction of the pedal part 20 is pushed downward in the vertical direction. Moreover, the connecting member 30 with the one end side pivotally connected to the third shaft O3 is pushed downward in the vertical direction. Hereby, the fourth shaft O4 pivotally connected to the other end side of the connecting member 30 is pushed downward in the vertical direction. As a result, the rotating body 40 rotates in the other direction (counter-clockwise direction in FIGS. 4A and 4B).

The striking part 50 is positioned opposite to the fourth shaft O4 and the pedal part 20 with the first shaft O1 interposed therebetween in the horizontal direction. Therefore, the rotating body 40 rotates in the other direction while the fourth shaft O4 is pushed downward in the vertical direction. As a result, the striking part 50 rotates about the first shaft O1 in the other direction while being lifted upward in the vertical direction.

In this way, a player can sense a weight by lifting up the striking part 50 upward in the vertical direction when the stepping operation on the pedal part 20 is performed.

In the pedal apparatus which is used when playing the acoustic bass drum, the striking part is lifted upward in the vertical direction in a manner following the stepping operation on the pedal part. Therefore, a player senses a weight when stepping on the pedal part of the pedal apparatus.

In the pedal percussion instrument 100, a player can feel a weight feeling when performing the stepping operation on the pedal part 20. Accordingly, the sense of operation similar to that of playing the acoustic bass drum by stepping the pedal apparatus can be obtained.

Moreover, the striking part 50 rotates in a manner that the striking part 50 is disposed opposite to the pedal part 20 with the first shaft O1 interposed therebetween in the horizontal direction. Therefore, comparing with a case in which the striking part 50 is located below the pedal part 20, it is not necessary to provide a space for rotating the striking part 50 between the pedal part 20 and the base plate 11 of the base 10. As a result, a height of the pedal percussion instrument 100 can be reduced.

When comparing the present invention with a case that the striking part 50 is disposed in a space between the pedal part 20 and the pair of the erected parts 13 of the base 10 in the horizontal direction and is rotated in one direction in a manner following the stepping of the pedal part 20, the pair of the erected parts 13 of the present invention can be disposed at a position close to the pedal part 20. Accordingly, a length in the longitudinal direction of the base 10 can be reduced. Moreover, when the rotating body 40 is detachable with respect to the erected parts 13 of the base 10, the pedal percussion instrument 100 is compactly portable by removing the rotating body 40.

When the pedal part 20 is stepped toward the one direction in a predetermined angle and the striking part 50 is rotated in the other direction in a predetermined angle, the stricken part 60 is struck by the striking part 50. At this time, the elastic member 51 including a rubber material can abut the stricken plate 61. Therefore, a percussion sound of the stricken part 60 caused by the striking part 50 can be reduced.

In addition, the elastic member 51 has another cross-section parallel to the surface of the striking part 60. The area of the another cross-section increases as the distance between the another cross-section of the elastic member 51 and surface of the stricken part 60 decreases. Accordingly, the stronger the striking part 50 presses the stricken part 60, the greater the force rebounding the striking part 50 toward one direction (a clockwise direction in FIG. 3) and the greater the force pushing the pedal part 20 toward the other direction (a counter-clockwise direction in FIG. 3) by an elastic restoring force of the elastic member 51.

When uses the striking part of the pedal apparatus to strike a head which is configured as the stricken surface of the acoustic bass drum, the stronger the striking part presses the head, the greater the rebounding force is to rebound the striking part and the greater the pushing force is to push the pedal part toward the other direction due to a tension of the head.

Therefore, in the pedal percussion instrument 100, when a player performs the stepping operation on the pedal part 20 and the striking part 50 strikes the stricken part 60, a sense of operating the pedal apparatus similar to that of using the pedal part to strike the acoustic bass drum by the pedal apparatus can be obtained.

In addition, the striking part 50 includes the weight part 52 as a weight. Therefore, even if a distance between the striking part 50 and the first shaft O1 is shortened, a player can sufficiently feel a weight feeling when striking the acoustic bass drum by the pedal apparatus. Therefore, a feeling similar to playing the acoustic bass drum by stepping the pedal apparatus can be obtained while the size of the pedal percussion instrument 100 is reduced.

In the embodiment, the elastic member 51 is formed to have a substantially triangular cross-section perpendicular to the first shaft O1. Moreover, the weight part 52 is attached to a contrary side of the stricken part 60 with respect to the elastic member 51. In other words, a center of gravity G of the striking part 50 is located on a position further away from the stricken part 60 than a virtual line 1 passing through the fourth shaft O4 and the first shaft O1.

Hereby, comparing with a case in which the center of gravity G of the striking part 50 is located on the virtual line 1, longer distance between the center of gravity G of the striking part 50 and the first shaft O1 can be ensured. Accordingly, a weight feeling of performing the stepping operation of the pedal 20 can be increased.

By rotating the pedal part 20 in one direction by stepping, the rotating body 40 is rotated in the other direction, and the spring member 81 of the bias member 80 connecting the projection 41*a* of the rotating body 40 and the spring connecting part 14 of the base 10 is extended. Therefore, when the stepping on the pedal part 20 is released, the rotating body 40 is rotated in one direction (clockwise direction in FIG. 3) by the biasing force of the spring member 81. Moreover, the pedal part 20 is rotated in the other direction (counter-clockwise direction in FIG. 3). Therefore, when the stepping on the pedal part 20 is released, the pedal part 20 and the rotating body 40 can be returned to a position before performing the stepping operation on the pedal part 20.

The striking part 50 includes the weight part 52. Therefore, when the pedal part 20 is released after being stepped and the rotating body 40 rotates in the one direction, the striking part 50 rotates further downward than the initial condition due to the gravity acting on the weight part 52.

The striking part 50 is held away from the floor surface and the base plate 11 of the base 10 in the initial condition. Therefore, the striking part 50, which rotates in one direction after the stepping on the pedal part 20 is released, can be easily prevented from crashing into the floor surface or the base plate 11. As a result, damaging to the striking part 50 and the floor surface or the base plate 11 due to the crash between the striking part 50 and the floor surface or the base plate 11 can be suppressed. Moreover, a crashing sound caused by the crash between the striking part 50 and the floor surface or the base plate 11 can be reduced.

Moreover, the striking surface 61*a* of the stricken part 60 is positioned higher than the first shaft O1 in the vertical direction, and the striking surface 61 a is located closer to the pedal part 20 than the axis center of the first shaft O1 in the horizontal direction. Therefore, even if the striking part 50 is held apart from the floor surface and the base plate 11 in the initial condition, a distance between the striking part 50 and the stricken part 60 can be sufficiently ensured. An amplitude of the striking part 50 for striking the stricken part 60, which is a distance that the striking part 50 travels to abut against the stricken part 60 from the moment the pedal not being stepped on till the moment the pedal being stepped on, can be ensured. Thus, a rotation angle of the pedal part 20 when the striking part 50 strikes the stricken part 60 can be ensured. Therefore, the rotation angle of the pedal part 20 can be approximated as a rotation angle of the pedal when the acoustic bass drum is struck by the pedal apparatus. Accordingly, the sense of operation similar to that of playing the acoustic bass drum by stepping the pedal apparatus can be obtained.

A cushion material including an elastic material, such as a rubber or urethane, may be disposed on a surface of the weight part 52 opposite to a surface attached with the elastic member 51 (that is a surface of the striking part 50 facing the base plate 11), or on a part of the base plate 11 facing the striking part 50. Since the cushion material is disposed at a position at which the cushion material is abuttable to the striking part 50 as the striking part 50 has rotated further downward than the initial condition, a damage to the striking part 50 or the base plate 11 due to a crash between the striking part 50 and the base plate 11 can be prevented. Moreover, a crashing sound caused by the crash between the striking part 50 and the floor surface or the base plate 11 can be reduced. In addition, the cushion material may be disposed at a position of the fixing plate 62 of the stricken part 60 facing the other end side of the rotating body 40. Since the cushion material is disposed at a position at which the cushion material is abuttable to the other end side of the rotating body 40 as the rotating body 40 has rotated further in the one direction than the initial condition, a rotation of the rotating body 40 toward the one direction can be restricted. Therefore, the crash between the striking part 50 and the floor surface or the base plate 11 can be prevented.

Next, referring to FIG. 4, a second embodiment is described. In the first embodiment, the pedal percussion instrument 100, which is an electronic percussion instrument including the vibration sensor 70, is introduced. In the second embodiment, a pedal percussion instrument 200 for training is introduced. The same reference numbers, as employed in the first embodiment, refer to the same parts, and explanation thereof in detail will be omitted herein.

Figure 4A:
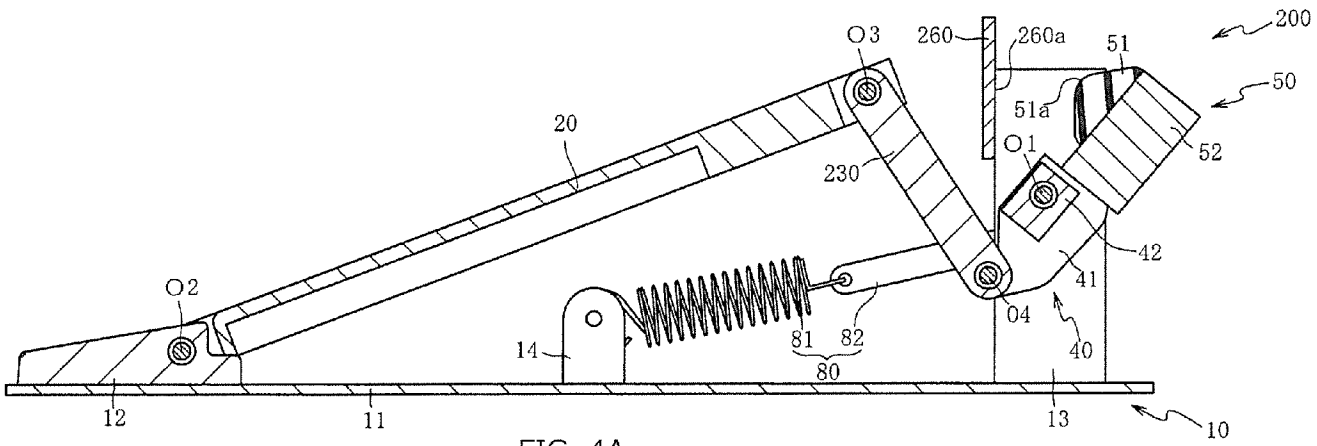
FIG. 4A is a cross-sectional view of a pedal percussion instrument according to a second embodiment.
Figure 4B:
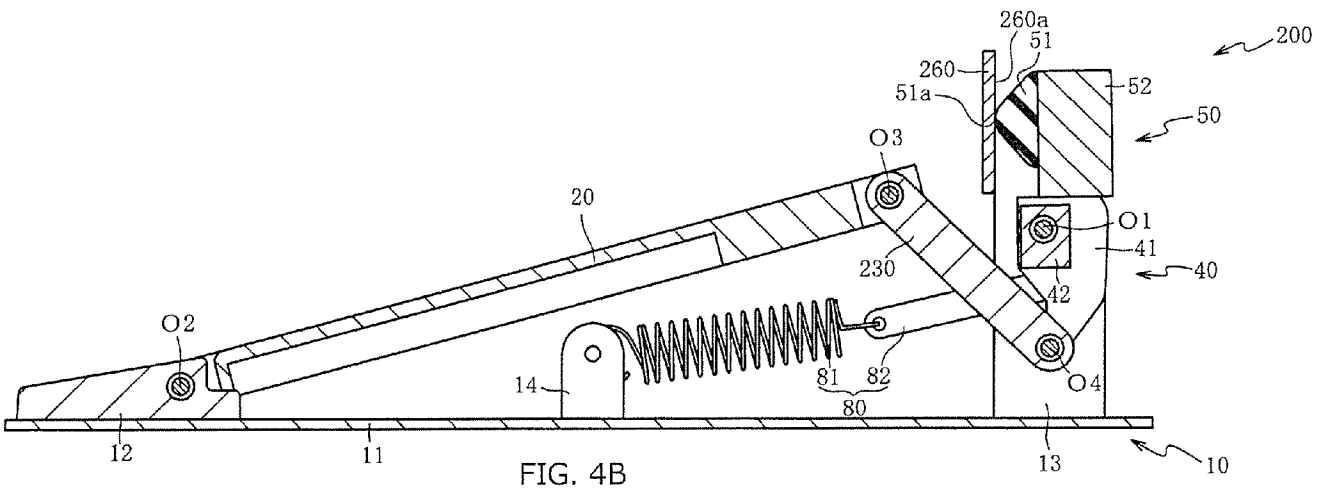
FIG. 4B is a cross-sectional view of the pedal percussion instrument according to the second embodiment.

FIG. 4A and FIG. 4B are cross-sectional views of the pedal percussion instrument 200 according to the second embodiment. FIG. 4A illustrates a state in which the stepping operation on the pedal part 20 is not performed. FIG. 4B illustrates a state in which the stepping operation on the pedal part 20 is performed and the stricken part 260 is struck by the striking part 50. In FIG. 4A, a cross-section corresponding to FIG. 1B is shown. In FIG. 4B, a cross-section corresponding to FIG. 3 is shown.

As shown in FIGS. 4A and 4B, the pedal percussion instrument 200 is a pedal apparatus having a striking part which rotates following a stepping operation of a pedal part. Moreover, the pedal percussion instrument 200 is a percussion instrument for training which simulates the playing of an acoustic bass drum by using a pedal apparatus.

The connecting member 230 in the second embodiment is longer than the connecting member 30 in the first embodiment in a longitudinal direction of the connecting member 230. Hereby, in the initial condition, a height of the fourth shaft O4 in the second embodiment can be lower than a height of the fourth shaft O4 in the first embodiment while a height of the third shaft O3 in the second embodiment is equal to the height of the third shaft O3 in the first embodiment. As a result, the striking part 50 in the second embodiment can be held further away from the floor surface and the base plate 11 than the striking part 50 of the first embodiment.

The stricken part 260 is a part struck by the striking part 50. The stricken part 260 is formed in a plate shape and fixed on the pair of erected parts 13 of the base 10. In addition, a stricken surface 260*a*, which faces the striking part 50, is positioned closer to the pedal part 20 than the first shaft O1 in the horizontal direction (closer to the left side in FIG. 4B).

In the above-mentioned first embodiment, the space S is formed between the stricken plate 61 and the fixing plate 62, and the vibration sensor 70 is disposed in the space S. The vibration sensor 70 is not disposed on the stricken part 260 in the second embodiment. Therefore, the striking surface 260*a* can be disposed on a side closer to the pedal part 20 than the striking surface 61*a* in the first embodiment (left side in FIG. 3).

In this way, in the pedal percussion instrument 200, the stricken surface 260*a* of the stricken part 260 can be disposed closer to the pedal part 20 while the striking part is held further away from the floor surface and the base plate 11 in the initial condition. As a result, a distance between the striking part 50 and the stricken part 260 can be sufficiently ensured.

Hereby, it is easily to prevent the striking part 50, which rotates in one direction after the stepping of the pedal part 20 is released, from crashing onto the floor surface or the base plate 11. At the same time, an amplitude of the striking part 50, which is a distance that the striking part 50 travels to abut against the stricken part 260 from the moment the pedal not being stepped on till the moment the pedal being stepped on, can be ensured. In other words, the rotation angle of the pedal part 20 when the striking part 50 strikes the stricken part 260 can be ensured. Therefore, the rotation angle of the pedal part 20 can be approximated as a rotation angle of the pedal when the acoustic bass drum is struck by the pedal apparatus. Accordingly, the sense similar to that of playing the acoustic bass drum by stepping the pedal apparatus can be obtained.

In the embodiment, the connecting member 330 is longer than the connecting member 30 in the first embodiment in the longitudinal direction of the connecting member 330. Moreover, a height of the fourth shaft O4 in the initial condition is lower than the height of the fourth shaft O4 in the first embodiment. As a result, the striking part 50 can be held further away from the floor surface or the base plate 11 than the striking part 50 in the first embodiment. The striking part 50 may be configured to be close to the stricken part 260 in parallel to or obliquely to the pair of rotating plates 41 of the rotating body 40 while a length of the connecting member 230 in the longitudinal direction of the connecting member is equal to that of the connecting member 30 in the first embodiment. Hereby, the striking part 50 can be held further away from the floor surface and the base plate 11 than the striking part 50 in the first embodiment.

Figure 5A:
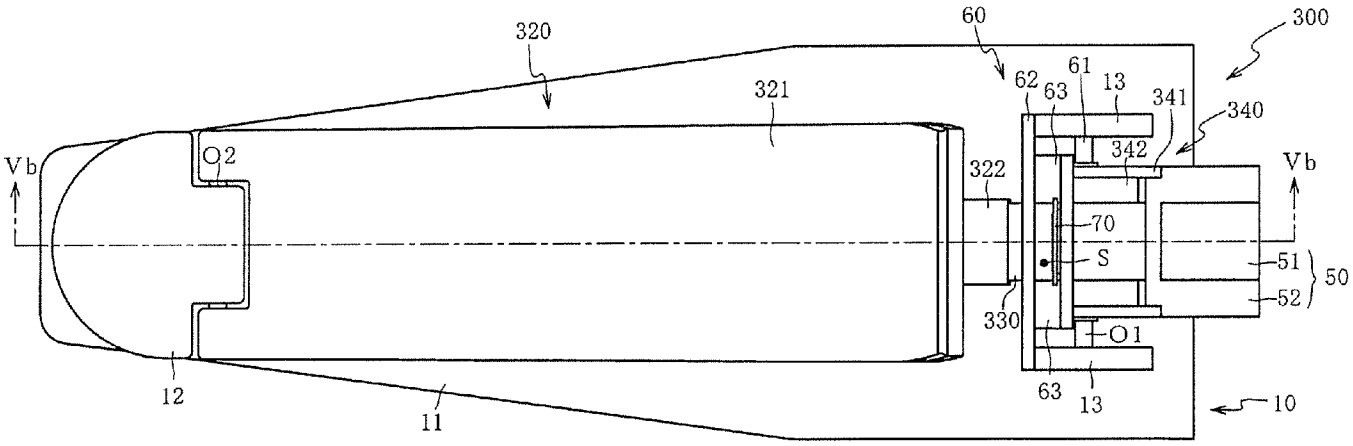
FIG. 5A is a top view of a pedal percussion instrument according to a third embodiment.
Figure 5B:
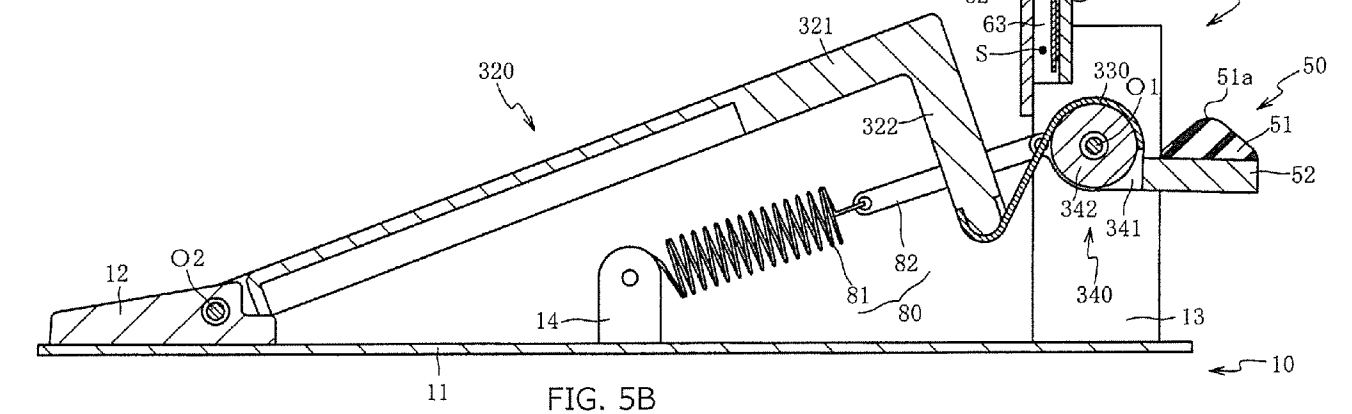
FIG. 5B is a cross-sectional view of the pedal percussion instrument on the line Vb-Vb in FIG. 5A.

Next, referring to FIGS. 5A and 5B, a third embodiment is described. In the first embodiment, a case has been described in which the connecting member 30 is configured as a link which has a predetermined stiffness. In the third embodiment, a case is described in which the connecting member 330 includes a belt-shaped member. The same reference numbers, as employed in the first embodiment, refer to the same parts, and explanation thereof in detail will be omitted herein.

FIG. 5A is a top view of a pedal percussion instrument 300 according to the third embodiment. FIG. 5B is a cross-sectional view of the pedal percussion instrument 300 on the line Vb-Vb in FIG. 5A.

As shown in FIGS. 5A and 5B, the pedal percussion instrument 300 is a pedal apparatus having a striking part which rotates in a manner following a stepping operation of a pedal part. Moreover, the pedal percussion instrument 300 is an electronic percussion instrument which simulates an acoustic bass drum for playing by using the pedal apparatus. The pedal percussion instrument 300 mainly includes the base 10, a pedal part 320, a connecting member 330, a rotating body 340, the striking part 50, the stricken part 60 and the vibration sensor 70. The pedal part 320 is pivotally connected to the base 10 in a manner that the pedal part 320 is rotatable. One end of the connecting member 330 is connected to the pedal part 320. The rotating body 340 is pivotally connected to the other end side of the connecting member 330 in a manner that the rotating body 340 being rotatable.

The pedal part 320 is a part for performing the stepping operation by a player and has a substantially L-shaped cross-section. The pedal part 320 is formed in a long plate shape. Moreover, the pedal part 320 includes a pedal main body 321 and a pedal extending part 322. The pedal main body 321 has one end side in the longitudinal direction and the one end side of the pedal main body 321 is rotatably held on the pedal pivot part 12. The pedal extending part 322 is extended substantially vertically to the pedal main body 321 from the other end of the pedal main body 321 in the longitudinal direction of the pedal main body 321. An extended tip of the pedal extending part 322 is formed in a substantial arc shape in cross-section.

The connecting member 330 connects the pedal part 20 and the rotating body 340. The connecting member 330 is a part including a belt-shaped member. The one end side of the connecting member 330 is fastened to a tip of the pedal extending part 322 of the pedal part 320.

The rotating body 340 is a part which rotates in a manner following the stepping operation of the pedal part 320 by a player. The rotating body 340 is positioned opposite to the pedal part 320 with the connecting member 330 interposed therebetween in the horizontal direction. The rotating body 340 includes a pair of rotating plates 341 facing each other and a rotating shaft part 342 for connecting the pair of the rotating plates 341.

The rotating shaft part 342 is formed in a cylindrical shape. The other end side of the connecting member 330 is fastened to an outer circumference surface of the rotating shaft part 342. In addition, since the first shaft O1 is disposed inside the rotating shaft part 342 and the first shaft O1 and the rotating shaft part 342 are pivotally connected, the rotating body 340 is rotatably held to the pair of erected parts 13 of the base 10. The striking part 50 fastened to the pair of the rotating plates 341 is disposed on one end side of the rotating shaft part 342. The striking part 50 is disposed on a side opposite to the pedal part 320 with the first shaft O1 interposed therebetween.

The one end side of the connecting member 330 is fastened to a surface of the pedal extending part 322, wherein the surface is opposite to another surface of the pedal extending part 322 facing the rotating body 340. Moreover, the other end side of the connecting member 330 is fastened at a position of the rotating shaft part 342 further away from the pedal part 20 than the first shaft O1 in the initial condition. In other words, the connecting member 330 connects the pedal extending part 322 of the pedal part 320 and the rotating shaft part 342 of the rotating body 340 in a manner that the connecting member 330, when it is in the initial condition, is bent into a substantially S-shape.

The other end side of the biasing force transmission part 82 (right side in FIG. 5B) is connected to an outer circumference part of the rotating shaft part 342. In the initial condition, a connecting position of the rotating shaft part 342 and the other end side of the biasing force transmission part 82 is higher (upper side in FIG. 5B) than a line connecting a connecting portion of the other end side of the spring member 81 and the one end side of the biasing force transmission part 82 and the first shaft O1. In other words, in the initial condition, the rotating shaft part 342 rests in a manner that the connecting position of the rotating shaft part 342 and the other end side of the biasing force transmission part 82 is above the line connecting the connecting portion of the other end side of the spring member 81 and the one end side of the biasing force transmission part 82 and the first shaft O1.

Hereby, when the pedal part 320 is rotated in one direction (clockwise direction in FIG. 5B) resulted from the stepping operation performed on the pedal main body 321 by a player and the pedal extending part 322 is pushed downward, the connecting member 330 is pulled toward the pedal part 320. Then, the rotating body 340 is rotated in the other direction (counter-clockwise direction in FIG. 5B) and the striking part 50 rotates about the first shaft O1 in the other direction.

Moreover, when the pedal part 320 is rotated a predetermined angle in one direction, the stricken part 60 is struck by the striking part 50.

In addition, when the stepping of the pedal main body 321 is released after being stepped, the rotating body 340 is rotated in the one direction by a biasing force of the spring member 81 of the biasing member 80. Hereby, the connecting member 330 is pulled toward the rotating part 340. Therefore, the pedal part 320 is rotated in the other direction while the pedal extending part 322 is lifted up.

At this time, in the initial condition, the rotating shaft part 342 rests in a manner that the connecting position of the rotating shaft part 342 and the other end side of the biasing force transmission part 82 is above the line connecting the connecting portion of the other end side of the spring member 81 and the one end side of the biasing force transmission part 82 and the first shaft O1. Therefore, the biasing force of the spring member 81 can suppresses the striking part 50 to rotate too much in the one direction due to its own weight.

When performing the stepping operation on the pedal part 321 and striking the stricken part 60 by the striking part 50, a player can sense a mass or a weight by lifting the striking part 50 upward in the vertical direction. Therefore, the sense of operating the pedal apparatus, being similar to that of using the pedal apparatus to play the acoustic bass drum by stepping on the pedal part of the pedal apparatus, can be obtained.

Moreover, the striking part 50 rotates in a manner that the striking part 50 is disposed opposite to the pedal part 320 with the first shaft O1 interposed therebetween in the horizontal direction. Therefore, comparing with a case in which the striking part 50 is disposed in a space between the pedal part 320 and the base plate 11 of the base 10 in the vertical direction, a height of the pedal percussion instrument 300 can be reduced.

When comparing the present invention with a case that the striking part 50 is disposed in a space between the pedal part 320 and the pair of erected parts 13 of the base 10 in the horizontal direction and is rotated in the one direction following the stepping on the pedal part 320, the pair of erected parts 13 of the present invention can be disposed at a position close to the pedal part 320. Therefore, a length of the base 10 in the longitudinal direction of the base 10 can be reduced.

The present invention was described with respect to the embodiments but the present invention is not limited to the above-mentioned embodiments. It should be apparent to those skilled in the art that various changes and modifications can be made within the spirit and scope of the invention.

Figure 6:
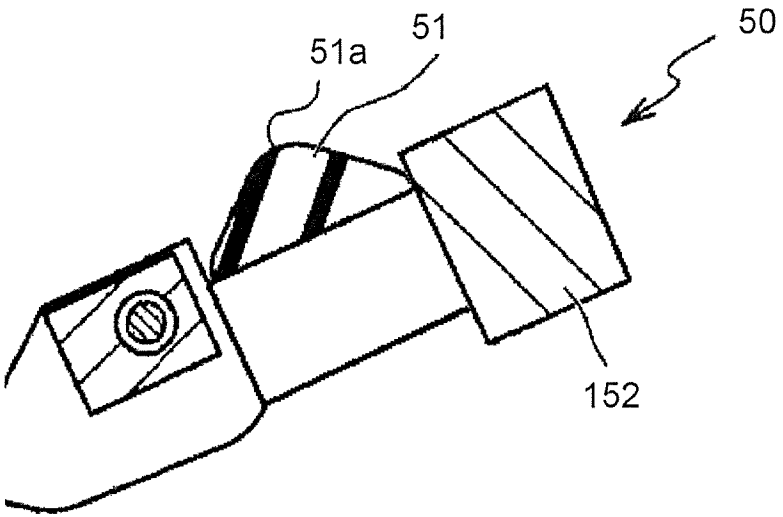
FIG. 6 is another example of the striking part.

For example, in each of the above-mentioned embodiments, the striking part 50 includes the elastic member 51 disposed thereon at the position facing the stricken part 60, 260 and the weight part 52 attached to the elastic member 51 at a side opposite to the side facing the stricken part 60, 260. Alternatively, the striking part 50 may only include the elastic member 51, and the elastic member 51 may be used as a weight. Hereby, a structure of the striking part 50 can be simplified so that a manufacturing cost of the pedal percussion instrument 100, 200, 300 can be reduced. Moreover, as shown in FIG. 6, the weight part 52 may be disposed at a tip end of the striking part 50, wherein the tip end of the striking part 50 is opposite to the first shaft O1 with the elastic member 51 interposed therebetween. With this arrangement, even if the weight part is less weight, a sense similar to a sufficient weight sense which is obtained when striking the acoustic bass drum can be obtained by the pedal apparatus. Thus, the pedal percussion instrument 100 can be lighter while the sense of operating the pedal percussion instrument 100 can be similar to the sense of using a pedal apparatus to play an acoustic bass drum by stepping on the pedal apparatus.

In each of the above-mentioned embodiments, the stricken surface 61*a*, 260*a* of the stricken part 60, 260 is disposed on the side closer to the pedal part 20, 320 than the first shaft O1 in the horizontal direction. Alternatively, the stricken surface 61*a*, 260*a* may be disposed on a side closer to the striking part 50 than the first shaft O1 in the horizontal direction. By configuring the striking surface 61*a*, 260*a* to be higher than the first shaft O1 in the vertical direction, even if the striking part 50 is held away from the floor surface and the base plate 11 in the initial condition, the distance between the striking part 50 and the stricken part 60 can be ensured.

In each of the above-mentioned embodiments, the elastic member 51 is formed to have a substantially triangular cross-section perpendicular to the first shaft O1. Alternatively, the elastic member 51 may be formed in other shape, such as a plate shape with a constant thickness.

In each of the above-mentioned embodiments, the elastic member 51 is disposed on the striking part 50. Alternatively, the elastic member 51 may be attached to the stricken surface 61*a*, 260*a* of the stricken part 60, 260.

In each of the above-mentioned embodiments, the biasing member 80 includes the spring member 81 which includes an extension coil spring and has one end that is connected to the spring connecting part 14 of the base 10, and the biasing force transmission part 82, wherein the one end side of the biasing force transmission part 82 is connected to the other end of the spring member 81 and the other end side of the biasing force transmission part 82 is connected to the rotating body 40, 340. Alternatively, the biasing member 80 may only include the spring member 81, and one end of the spring member 81 may be connected to the base 10 and the other end of spring member 81 may be connected to the lower surface of the pedal part 20, 320.

In the above-mentioned first and third embodiments, the pedal percussion instrument 100, 300 include the vibration sensor 70. Alternatively, the pedal percussion instrument 100, 300 may include a sheet sensor attached to the striking surface 61*a* (for example, membrane switch) instead of the vibration sensor 70. Hereby, a false detection of a vibration (for example, vibration transported from the floor) can be prevented. Therefore, comparing with the vibration sensor 70, a strike on the stricken part 60 by the striking part 50 can be surely detected. In addition, since the sheet sensor can detect a contact condition between the striking part 50 and the stricken part 60, an open-close playing technique can be performed.

The pedal percussion instrument 100, 300 may include both of the vibration sensor 70 and the sheet sensor. In this case, the strike on the stricken part 60 by the striking part can be detected by using the sheet sensor, and a velocity of the strike can be detected by using the vibration sensor 70. Hereby, a false vibration detection can be prevented and musical sound simulating the percussion sound of the acoustic bass drum can be generated from a sound source apparatus.

What is claimed is:

1. A pedal percussion instrument, comprising a base placed on a floor surface;

a pedal part pivotally connected to the base in a manner that one end side of the pedal part is rotatable;

a connecting member of which one end side connected to an other end side of the pedal part;

a rotating body connected to an other end side of the connecting member;

a first shaft pivotally connecting the rotating body in a manner that the rotating body is rotatable with respect to the base;

a striking part rotating about the first shaft and disposed on one end side of the rotating body; and a stricken part located on a rotational orbit of the striking part, wherein the first shaft is located between an upper end and a lower end in a longitudinal direction of the pedal part in a vertical direction when the pedal part is not being operated, the striking part is disposed on a side opposite to the pedal part in a horizontal direction with the first shaft interposed therebetween, and is disposed on a side lower than the stricken part in the vertical direction when the pedal part is not being operated, and the pedal part rotates in one direction with respect to the base, and the rotating body rotates via the connecting member in an other direction with respect to the base, and the stricken part is struck by the striking part through a rotation of the rotating body in the other direction in a predetermined angle.

2. The pedal percussion instrument as claimed in claim 1, wherein the striking part and the stricken part are disposed in a manner that the striking part and the stricken part face each other, and one of the striking part and the stricken part comprises an elastic member including an elastic material, and the striking part comprises a weight part as a weight.

3. The pedal percussion instrument as claimed in claim 1, comprising, a biasing member applying a biasing force to the pedal part or the rotating body, wherein the biasing force of the biasing member causes the other end side of the pedal part to be held at a predetermined height and the striking part to be held apart from the floor surface and the base when the pedal part is not being operated, and when the pedal part is rotated in the one direction and the rotating body is rotated in the other direction, the biasing force of the biasing member causes the rotating body to be rotated in the one direction and the pedal part to be rotated in the other direction.

4. The pedal percussion instrument as claimed in claim 1, wherein a stricken surface of the stricken part, which is struck by the striking part, is positioned higher than an axis center of the first shaft in the vertical direction.

5. The pedal percussion instrument as claimed in claim 1, wherein the stricken surface of the stricken part is located closer to the pedal part than an axis center of the first shaft in the horizontal direction.

6. The pedal percussion instrument as claimed in claim 1, wherein the striking part and the stricken part are disposed in a manner that the striking part and the stricken part face each other, and one of the striking part and the stricken part comprises an elastic member including an elastic material, and the elastic member is disposed at a surface of the one of the striking part and the stricken part and has a cross-section parallel to the surface of the one of the striking part and the stricken part, and an area of the cross-section increases as a distance between the cross-section of the elastic member and the surface of the one of the striking part and the stricken part decreases.

7. The pedal percussion instrument as claimed in claim 1, comprising a second shaft pivotally connecting the pedal part in a manner that the one end side of the pedal part is rotatable with respect to the base;

a third shaft located above the second shaft and pivotally connecting the connecting member in manner that the one end side of the connecting member is rotatable with respect to the other end side of the pedal part; and a fourth shaft located on a side opposite to the second shaft in the horizontal direction with the third shaft interposed therebetween and located on a side opposite to the striking part in the horizontal direction with the first shaft interposed therebetween, and is between the second shaft and the third shaft in the vertical direction, and pivotally connecting the rotating body in a manner that the other end side of the rotating body is rotatable with respect to the other end side of the connecting member, wherein the connecting member being configured as a link having a predetermined stiffness.

8. The pedal percussion instrument as claimed in claim 7, wherein a distance between an axis center of the first shaft and a center of gravity of the striking part is shorter than a distance between the axis center of the first shaft and an axis center of the fourth shaft.

9. The pedal percussion instrument as claimed in claim 7, wherein a distance between an axis center of the first shaft and a striking point of the striking part which first abuts the stricken part, is shorter than a distance between the axis center of the first shaft and an axis center of the fourth shaft.

10. The pedal percussion instrument as claimed in claim 3, wherein the biasing member is held between the base and the pedal part in a manner that the biasing member is approximately parallel to the pedal part when the pedal part is not being operated.

11. The pedal percussion instrument as claimed in claim 7, wherein an axis center of the first shaft is located between the striking part and an axis center of the fourth shaft.

12. The pedal percussion instrument as claimed in claim 7, wherein a center of gravity of the striking part is located further away from the stricken part than a virtual line passing through the fourth shaft and the first shaft.

13. The pedal percussion instrument as claimed in claim 1, wherein the connecting member includes a rod-shaped member having a predetermined stiffness.

14. The pedal percussion instrument as claimed in claim 1, wherein the connecting member includes a belt-shaped member.

15. The pedal percussion instrument as claimed in claim 1, wherein a side of the striking part that faces the base or a side of the base that faces the striking part is provided with an elastic member including an elastic material.

16. The pedal percussion instrument as claimed in claim 1, wherein the stricken part comprises a sensor for detecting a strike caused by the striking part.

* * * * *